United States Patent [19]

Piaget

[11] 4,376,991

[45] Mar. 15, 1983

[54] ELECTRONIC WATCH WITH ANALOGIC DISPLAY

[75] Inventor: Valentin Piaget, La Côte-aux-Fées, Switzerland

[73] Assignee: Complications S.A., Neuchatel, Switzerland

[21] Appl. No.: 287,578

[22] Filed: Jul. 28, 1981

[30] Foreign Application Priority Data

Aug. 18, 1980 [CH] Switzerland ..... 6210/80

[51] Int. Cl.[3] ..... G04B 19/24

[52] U.S. Cl. ..... 368/37; 368/28; 368/31; 368/35; 368/76; 368/77; 368/233

[58] Field of Search ..... 368/28, 31, 35, 37, 368/76, 77, 233

[56] References Cited

U.S. PATENT DOCUMENTS

| | | | |
|---|---|---|---|
| 3,276,198 | 10/1966 | Barbera | 368/28 |
| 3,815,351 | 6/1974 | Vovelle | 368/28 |
| 4,261,046 | 4/1981 | Ono et al. | 368/28 X |
| 4,282,592 | 8/1981 | Miyasaka | 368/35 X |

FOREIGN PATENT DOCUMENTS

| | | | |
|---|---|---|---|
| 190208 | 4/1937 | Switzerland . | |
| 2017356 | 3/1979 | United Kingdom . | |
| 1590467 | 6/1981 | United Kingdom | 368/28 |

*Primary Examiner*—Ulysses Weldon

*Attorney, Agent, or Firm*—Young & Thompson

[57] ABSTRACT

This watch comprises a date crown or date disc (9) pivoted onto a plate (10) and completely independent of a driving gear train (1, 2, 3). A second micro-motor (14) drives this crown (9) in its angular displacements.

3 Claims, 4 Drawing Figures

FIG. 2

FIG. 2
A-A
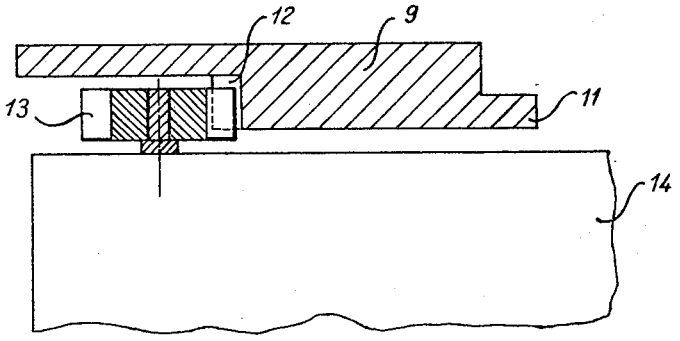
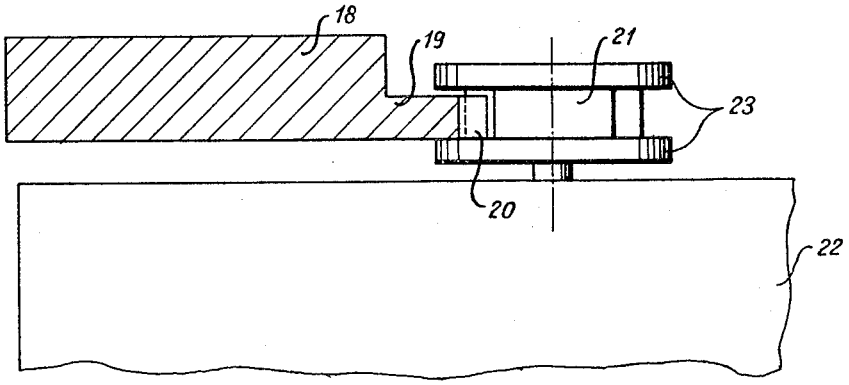
FIG. 4

ELECTRONIC WATCH WITH ANALOGIC DISPLAY

The present invention has for its object an electronic watch with analogical display comprising a micromotor driving gear train actuating the hands of the watch. These electronic analogic watches present a control circuit of the micro-motor driven by a time base comprising a quartz crystal. A removable battery is used for the electric energy of the control circuit, of the time base and of the micro-motor.

When these electronic watches with analogic display are provided with a numerical indication of the date, the date disc or date crown is mechanically driven by means of a reduction gear train from the hour wheel. This reduction gear train drives an eccentric subjected to the action of a spring which is progressively tightened during 24 hours to liberate its force in only one push permitting to instantaneously move forward the date crown against the action of its retaining pawl.

This construction is complicated and necessitates above all a motor having a much greater power than would be necessary for the driving of the hands since it is necessary to permanently tighten the spring causing the instantaneous passage of the date in overcoming its inertia and its retaining force.

The present invention tends to remedy these drawbacks and relates to an electronic watch having an analogic display provided with a date crown comprising, a micro-motor controlled by a control circuit driven by a time base, the whole being fed by a battery, and a driving gear train driven by the micro-motor and driving the hands of the watch, characterised by the fact that the date crown is independent from the driving gear train, and that it comprises a second micro motor for the driving of said date crown.

The attached drawing shows schematically and by way of example two embodiments of the watch according to the invention.

FIG. 2 is a cross section along line A—A of FIG. 1.

FIG. 4 is a variant of the watch.

Figure 1:
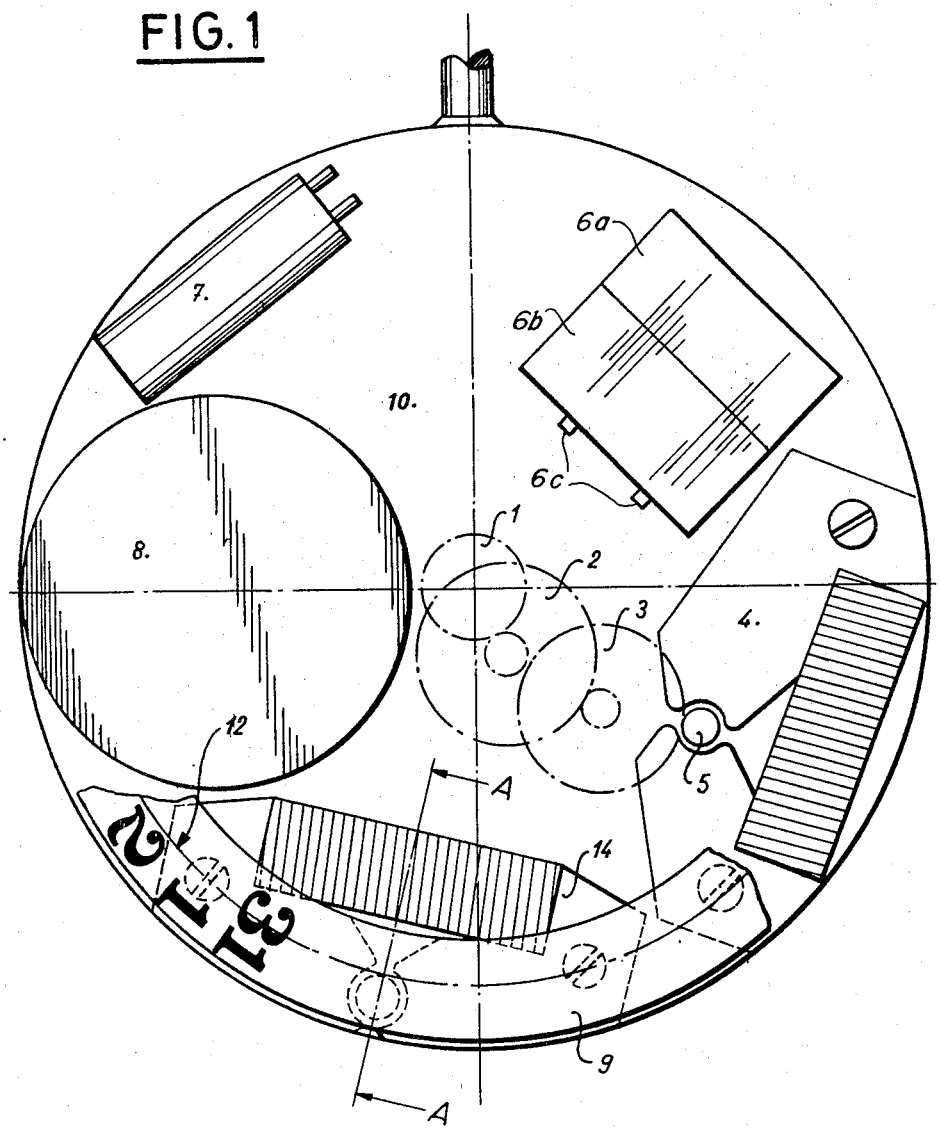
FIG. 1 shows in plan view and very schematically the first embodiment.

The electronic watch having an analogic display shown in part in FIGS. 1 and 2 comprises a driving gear train 1, 2, 3 driving the hands (not shown), driven in rotation by means of a micro-motor 4 the driving shaft 5 of which meshes with element 3 of the driving gear train. A control circuit 6*a* is provided to control the micro-motor 4 as well as a quartz time base 7. A battery 8 delivers the necessary electrical power for the working of the watch. This part of the watch is conventional and well known and will therefore not be described in detail.

This watch comprises further a date crown or date disc 9 pivoted on the plate 10 of the watch in a known manner, for example by means of three rollers (not shown) pivoted on the plate 10 and cooperating with a flange 11 of the crown 9.

This date crown 9 has a toothing 12 cut in its body meshing driven by a pinion 13 with the driving shaft of a second micro-motor 14.

The date crown 9 is thus freely pivoted on the plate 10, without any positioning for indexing member. In fact, when the second micro-motor is not energised, it is locked by the magnetic forces applied to its rotor through its permanent magnets and this locking is sufficient to provide for a perfect positioning of the date crown 9 taking into account the angular acceleration it may undergo as a consequence of the movements or shocks to which the watch can be exposed.

The power consumption of the micro-motor 4 for the driving of the hands is reduced, its power having to be just sufficient for the driving of the driving gear train. The power consumption of the second micro-motor 14 is negligible since it works only during a few seconds over a 24-hour period.

Through the programming of the control circuit 6*b* the forward movement of the date crown 9 can be caused to actuate a perpetual or partly perpetual date indicator.

It is evident that the control circuit comprises zero resetting outputs as well as date correcting outputs 6*c* to set the crown to the desired date. In fact during the change of battery it can happen that one loses the exact date.

Figure 3:
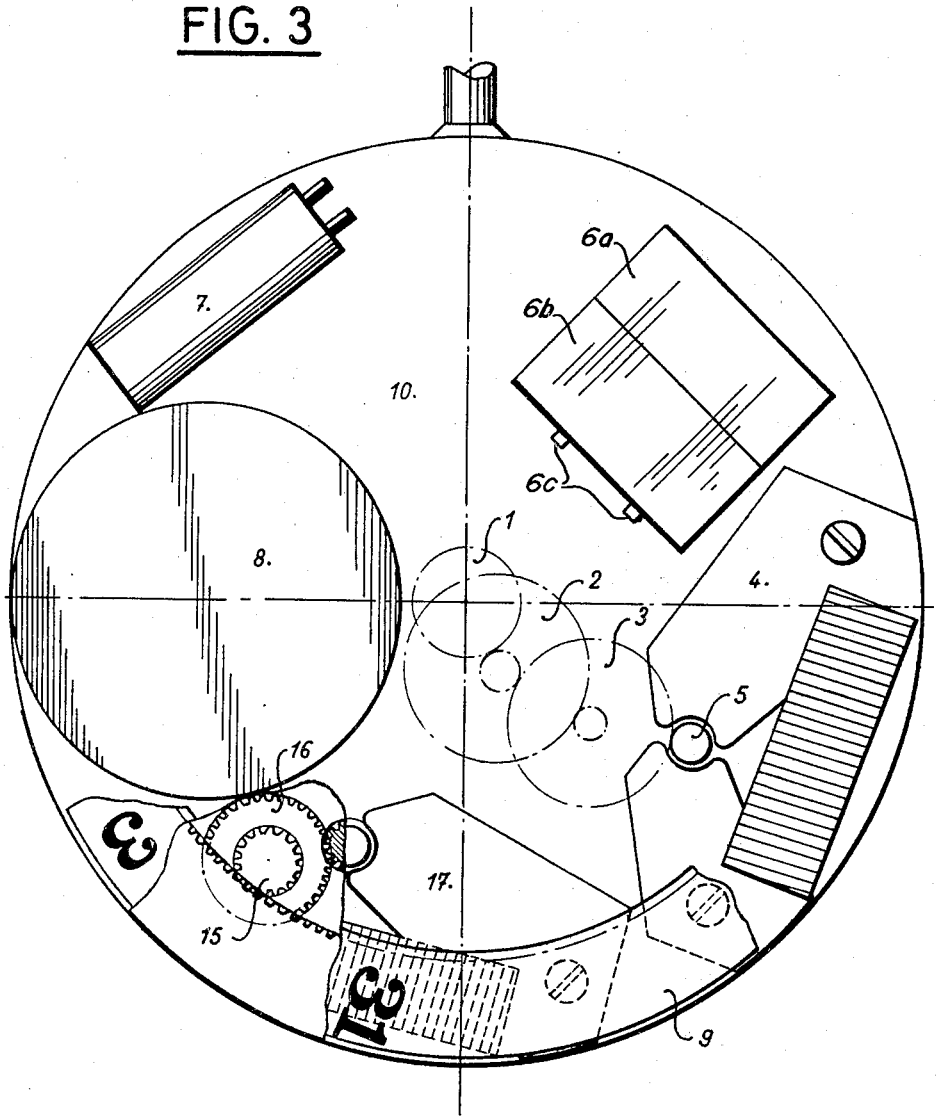
FIG. 3 is a very schematic top view of the second embodiment.

In the second embodiment shown in FIG. 3, the members 1 to 12 are the same as those of the first embodiment and will not be described in detail.

The toothing of the date crown 9 meshes with a pinion 15 of a toothed wheel 16 which is in mesh with the driving shaft of a second micro-motor 17 controlled exactly in the same manner as micro-motor 14 of the first embodiment.

Here also the date crown is freely pivoted on the plate 10, and has no mechanical connection with the driving gear train 1, 2, 3. Its positioning and locking are achieved solely by the micro-motor 17 and the gearing 15, 16.

In the variant shown in FIG. 4, the date crown 18 comprises a peripheral flange 19, the edge of which has a toothing 20. This toothing 20 meshes with the pinion 21 fast with the driving shaft of a second micro-motor 22 for the driving of the date crown 18. This pinion 21 comprises flanges 23 cooperating with the flange 19 for the pivoting of the crown 18. Two other rollers (not shown) are provided for the pivoting of this date crown 18.

While the invention has been described in detail and with reference to specific embodiments thereof, it will be apparent to one skilled in the art that various changes and modifications can be made therein without departing from the spirit and scope thereof.

What is claimed is:

1. In an electronic watch having an analogic hour and minute hand display and a date crown, comprising a first micro-motor controlled by a first control circuit driven by a time base and powered by a battery, and a gear train driven by said first micro-motor and driving the hands of the display of the watch; the improvement comprising a second micro-motor controlled by a second control circuit driven by said time base, said second micro-motor driving said date crown completely independently from the gear train driven by the first micro-motor.

2. Watch according to claim 1, in which the axis of the second micro-motor comprises a pinion meshing with a toothing of the date crown.

3. Watch according to claim 1 and at least one gear in mesh between toothing on the date crown and a pinion on a shaft of the second micro-motor.

* * * * *